US005175526A

United States Patent [19]

Martin

[11] Patent Number: 5,175,526

[45] Date of Patent: Dec. 29, 1992

[54] INDUCTANCE DEVICE, PARTICULARLY FOR SHORT WAVES

[75] Inventor: Jean-Marc Martin, St Leu la Foret, France

[73] Assignee: Thomson-CSF, Puteaux, France

[21] Appl. No.: 787,630

[22] Filed: Nov. 4, 1991

[30] Foreign Application Priority Data

Nov. 23, 1990 [FR] France ..... 90 14622

[51] Int. Cl.[5] ..... H01F 29/06

[52] U.S. Cl. ..... 336/139; 336/141; 336/144; 336/185

[58] Field of Search ..... 336/137, 139, 140, 141, 336/144, 185; 343/745

[56] References Cited

U.S. PATENT DOCUMENTS

| | | | |
|---|---|---|---|
| 1,190,007 | 5/1933 | Gebhard et al. | 336/139 |
| 1,860,722 | 5/1932 | Rudolph et al. | 336/139 |
| 1,911,980 | 5/1933 | Vance | 336/140 |
| 2,691,141 | 10/1954 | Hollis | 336/139 |
| 2,781,514 | 2/1957 | Sichak et al. | 336/144 |
| 2,783,441 | 2/1957 | Camilli et al. | 336/185 X |
| 2,839,634 | 6/1958 | Vercesi | 336/139 |
| 2,969,460 | 1/1961 | Rowley | 336/144 |
| 3,078,430 | 2/1963 | Majkrzak | 336/140 |
| 3,225,319 | 12/1965 | Trench | 336/185 X |
| 3,444,494 | 5/1969 | Cierley et al. | 336/141 |

FOREIGN PATENT DOCUMENTS

| | | | |
|---|---|---|---|
| 0290928 | 11/1988 | European Pat. Off. . | |
| 2641406 | 7/1990 | France . | |
| 36797 | 11/1965 | German Democratic Rep. | 336/139 |

*Primary Examiner*—Thomas J. Kozma

*Attorney, Agent, or Firm*—Oblon, Spivak, McClelland, Maier & Neustadt

[57] ABSTRACT

The invention concerns an inductance device formed on the basis of an asymmetrical line. This inductance device includes a plane conductor, preferably cylindrical, a linear conductor extending along and close to the plane conductor and having one end short-circuited with the plane conductor. Positioning devices make it possible to keep the linear conductor in a determined position in relation to the plane conductor. The inductance device is particularly used for the manufacture of power inductances for short waves.

8 Claims, 2 Drawing Sheets

"PRIOR ART"

INDUCTANCE DEVICE, PARTICULARLY FOR SHORT WAVES

BACKGROUND OF THE INVENTION

The invention concerns an inductance device. It concerns particularly short short wave devices, for high power transmission, for example 100 kw and above, such as are found for example in a radio transmitter.

An example of a short wave radio transmitter operating between 6 and 30 MHz notably includes an adaptor unit which incorporates an inductance device in the form of a coil made up of several turns side by side along an axis.

The design of an inductance device of this type operating over a wide frequency band is always a delicate problem. Indeed, this circuit only conserves its pure inductance properties in a restricted frequency band owing to parasite capacities, appearing as the frequency increases, which cause a considerable decrease in the resonance frequency of a circuit formed in this way. It is only below this resonance frequency, then, that the circuit has inductance properties.

This is particularly true in the present example where a circuit of large dimensions is necessary owing to the large currents involved and the high voltages which appear at the inductance terminals, etc., dimensions which are not negligible in relation to the wavelengths of the frequencies used.

Moreover, in the case where this type of inductance coil is adjustable by short circuiting a section of the coil of variable length, a dead section formed by this part of the coil lies in the magnetic field along the axis of the coil. Induced currents are thus produced in this dead section and modify the performance of the inductance assembly.

For these various reasons, it is at present almost impossible to anticipate — either by measurement or calculation — the behavior of such an inductance device in a frequency ratio which can range from about 4.3 to 8.6.

SUMMARY OF THE INVENTION

Apart from inductance coils, it is known that a transmission line comprising two conductors placed next .to each other, of given length L, may, if $L < \lambda/4$, $\lambda$ being the wavelength of the signal crossing the line, behave like an inductance coil whose value is proportional to L.

The Applicant has discovered that it is possible to take advantage of the inductive behavior of a transmission line in order to make a discrete component constituting an inductance, in a relatively compact space, while at the same time eliminating, or at least reducing, the disadvantages mentioned earlier.

According to the present invention there is provided an inductance device formed by an asymmetrical line and including a plane conductor, a linear conductor located along and close to the plane conductor and having a first end which is short-circuited with the plane conductor and a second end, and positioning devices for maintaining the linear conductor in a determined position in relation to the plane conductor.

BRIEF DESCRIPTION OF THE DRAWINGS

Further details and advantages of the invention will become apparent in the following description of a preferred but not limiting form of the embodiment, with reference to the attached drawings of which.

MORE DETAILED DESCRIPTION

Figure 1:
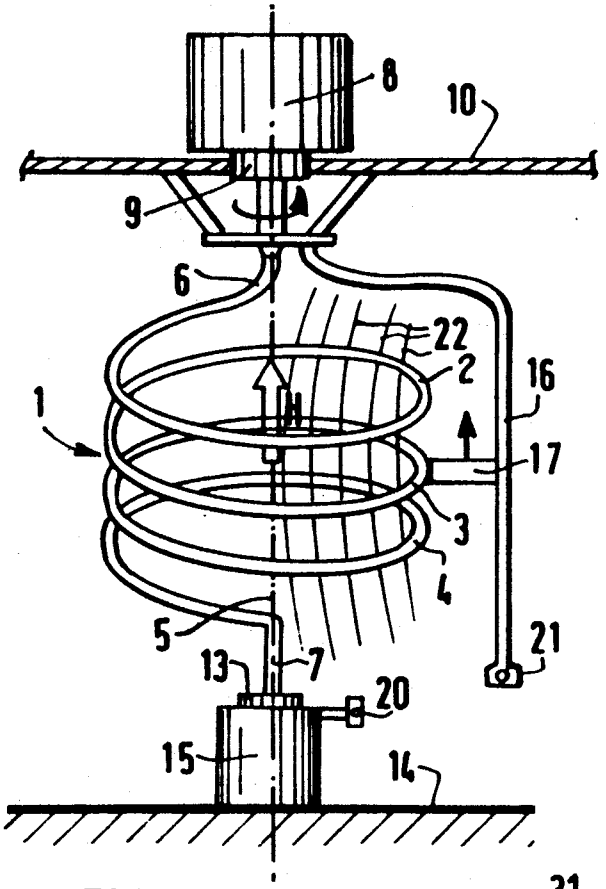
FIG. 1 is a front view of a variable inductance device of the prior art.

The prior art inductance device, shown in FIG. 1, includes a coil 1 consisting of a silvered copper tube wound into a coil and defining several turns 2 to 4 side by side along an axis 5 of the coil 1. The copper tube is thick enough to ensure that the coil 1 does not experience any perceptible deformation.

An upper end 6 of the coil 1 is linked, so that it is electrically insulated, to a motor 8 mounted on an upper earthing panel 10 by means of a bearing 9, whilst a lower end 7 of the coil is mounted on a bearing 13, which is in turn linked to a lower earthing panel 14 by means of a capacitor 15.

A fixed vertical return bar 16 extends parallel to the axis 5 of the coil 1 and is attached to the upper end 6 of the coil 1. A slide 17 extends between the return bar 16 and the coil 1 and is connected to them in a manner which is not portrayed in FIG. 1.

Between a terminal 20 linked to the lower end 7 of the coil and a terminal 21 placed at a free end of the return bar 16 an adjustable inductance is created.

The inductance is adjusted in the following manner. Operation of the motor 8 rotates the coil around its axis 5, which causes the slide 17 to move vertically along the return bar 16.

This changes the useful length of the coil 1.

Certain problems caused by such an inductance device are of a mechanical nature. The coil not being supported along its entire length, its rigidness is obtained by giving the copper tube a considerable constituent, diameter and thickness. Moreover, some deformation of the coil cannot be totally avoided and when the latter rotates this impairs the quality of the electric contact between the slide 17 and the coil or the return bar.

Other problems are of an electrical nature. At a high frequency, a single turn such as 4 is often sufficient to obtain the desired inductance value. In these conditions, the unused turns 2 and 3 and an unused section of the return bar 16 form a "dead section" lying in a magnetic field H defined by the field lines 22 extending throughout an internal section of the coil, coaxial with the latter, and rejoining on the exterior of the latter: this dead section changes the inductance value in a manner which is practically incalculable, which means that a precise correction can not be made.

This problem is especially evident because at high frequencies the length of such a dead section is no longer negligible compared with the wavelength. Moreover, the mechanical deformations of the coil alter the value of the stray capacities present between the turns, or between the turns and the return arm.

During use, parasitic frequencies and phenomena which disturb the harmonic frequencies of the utilization frequency are observed.

For this reason it is almost impossible to anticipate — either by measurement or by calculation — the behavior of such an inductance device used in a frequency ratio ranging from about 4.3 to 8.6.

Figure 2:
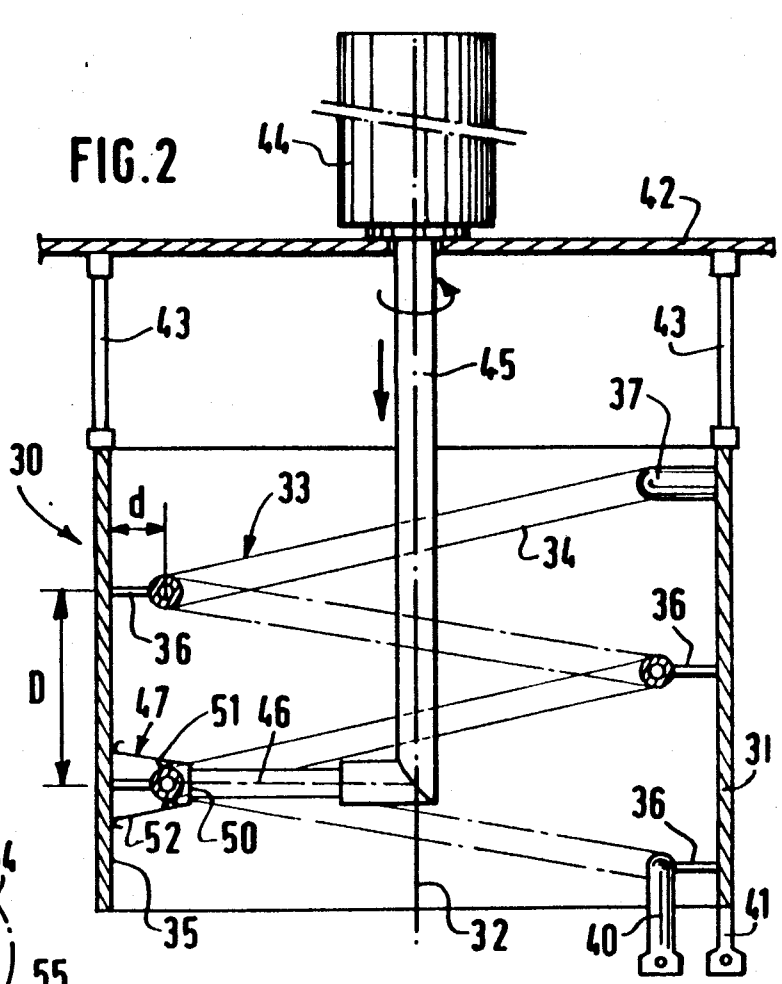
FIG. 2 is an axial cross sectional front view of a variable inductance device according to the invention.

An inductance device 30 according to the present invention is represented in FIG. 2. It includes a cylinder 31 having an axis 32 and made of a conductive material such as copper. In this example, the cylinder has a circular cross section and is open at both ends.

A coil 33 is placed coaxially in the cylinder 31. It is made of a conductor coiled so as to form two turns. In this example, the conductor is a copper tube 34.

The coil 33 is located in a position determined in relation to the cylinder 31 in order to ensure a strong electromagnetic coupling between the tube 34 and the cylinder while at the same time guaranteeing an electromagnetic decoupling between the two turns. This effect is obtained by taking a distance D between turns which is long in relation to a distance d between a center of the tube 34 and the internal face 35 of the cylinder 31. Tests have demonstrated that a value D which is at least three times, and preferably four times, that of d, was acceptable.

The coil 33 is fixed to the internal face 35 of the cylinder 31 by means of several small insulating bars 36 distributed along its length, each bar being perpendicular to the internal face 35 of the cylinder 31 and linking the latter to the tube 34. The insulating bars are specifically ceramic.

An upper end 37 of the tube 34 is attached directly to the internal face 35 of the cylinder 31, whilst a lower end 40 constitutes a connector. Another connector 41 is attached to the cylinder 31 next to the connector 40. Between the connectors 40 and 41, then, an electric circuit is formed, including, in series, the coil 33 and the cylinder 31.

The inductance device 30 is mechanically linked to an earthing panel 42, but electrically insulated from it by the insulating rods 43 attached to an upper edge of the cylinder 31. These insulating rods are specifically ceramic.

A motor 44 is attached to the face of the earthing panel 42 farthest away from the inductance device 30 and co-axial with the latter. It has a driving shaft 45, specifically metallic, which supports on a free end a transversal insulating rod 46. The insulating rod 46 supports on a free end a more-or-less U-shaped slide 47, having a base 50 attached to the insulating rod 46 and two wings 51 and 52.

The base 50 and the wings 51 and 52 of the slide 47 are in contact with the tube 34, the wings also having a free end pressed against the internal face 35 of the cylinder 31. The slide 47 thus ensures a localized electric contact between the coil 33 and the cylinder 31, short-circuiting an upper section of the inductance device 30.

The motor 44 is designed so that the driving shaft 45 moves both in rotation and axial translation corresponding to the movement of the slide 47 on the tube 34.

A device not shown in the drawing is provided to ensure that water circulates inside the tube 34, when the inductance device is under tension.

Figure 3:
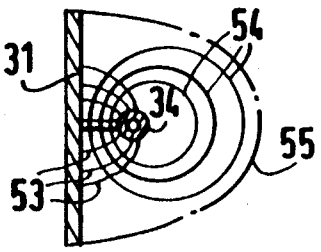
FIG. 3 is a detailed diagram of the inductance device in FIG. 2 illustrating the distribution of the lines of the magnetic and electric fields.

The operation of the inductance device is described below. Seen in cross section (FIG. 3), the tube 34 forms, with the adjacent flat conductor formed by the cylinder 31, an asymmetrical line of length L equal to the length of the tube 34, this line being short-circuited.

If the wavelength of a signal crossing the line is $\lambda$, it is known that if $L < \lambda/4$ the asymmetrical line behaves like an inductance whose value is proportional to L.

Between the tube 34 and the cylinder 31 are the lines of the electric field 53 linking these two parts, and the lines of the magnetic field 54, perpendicular to the aforementioned lines, encircle the tube 34.

The field is confined to a peripheral area around the tube 34 (FIG. 3), so that by choosing a large enough distance D between two adjacent turns, the peripheral areas 55 relating respectively to these two turns do not overlap. Moreover, when observed radially, the field lines are confined near to the cylinder 31, leaving an area along the inductance axis free of any electromagnetic field.

The electromagnetic field is therefore limited to a space defined by a solenoid surrounding the tube 34 and centered on it. This field, furthermore, is only present along a lower section of the tube 34 which is not short-circuited and extends between the slide 47 and the connector 40.

For this reason, an upper section of the inductance device located axially between the slide 47 and the upper end 37 of the tube 34 is not in a magnetic field and does not therefore influence the inductance value of a lower section of the latter.

Furthermore, because of the considerable electromagnetic coupling between the tube 34 and the cylinder 31, and the electromagnetic decoupling between any two adjacent turns of the coil 33, there exists between the tube and the cylinder a capacity which is considerable in relation to that which can exist between two adjacent turns of the coil 33, so that in practice the latter capacity is negligible in relation to the former.

Therefore, the capacities between turns of the coil 33 do not in practice modify the value of the inductance, even at high frequencies such as 150 MHz.

Another advantage of the invention is that the motor 44 and the driving shaft 45 are not in a magnetic field since they are located in an area next to the inductance axis: they will therefore not cause interference. For this reason the motor 44 does not necessarily need to be separated from the inductance device 30 by the earthing panel 42.

Depending on the case concerned, the motor 44 is designed either as a separate part of the inductance device 30, mounted on a joint support panel for these two parts, or as an integral part of the inductance, mounted on an insulating frame of the latter.

Alternatively, the tube 34 can be placed outside the cylinder 31 and attached to an external surface of the latter.

According to another variant, the inductance device 30 is not adjustable and therefore does not include a slide nor any means of movement.

In the example illustrated in the figures, the cylinder 31 comprises a return conductor of the inductance device 30. Alternatively, the return conductor is placed along the parts which drive the slide 47, that is along the rod 46 and the driving shaft 45.

Figure 4:
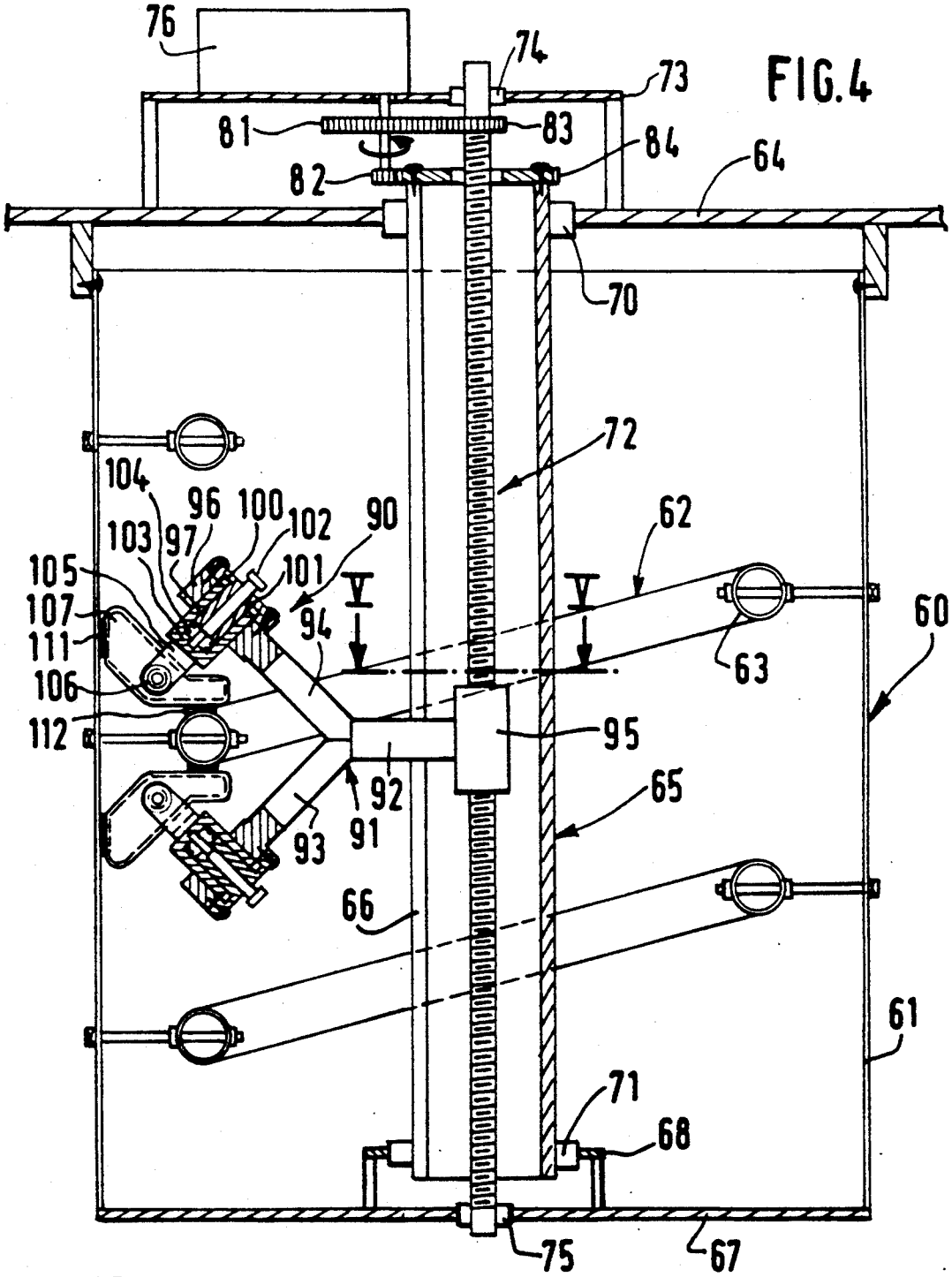
FIG. 4 is a cross sectional front view of a preferred embodiment of the inductance device.
Figure 5:
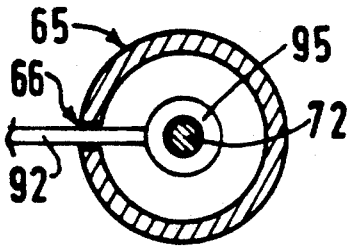
FIG. 5 is a partial cross section along line V—V of FIG. 4.

A practical embodiment of the inductance in FIG. 2 is shown in FIGS. 4 and 5. An inductance device 60 includes a cylinder 61 inside which is mounted a tube 63 of a coil 62. The inductance device 60 is suspended from a panel 64.

A split tube 65 having a longitudinal slit 66 is rotatably mounted at both ends, on the panel 64 and on a plate 68 standing on an insulating base 67 of the inductance device 60 by means of the bearings 70 and 71 respectively. A worm screw 72 is placed coaxially inside the split tube 65 and is longer than the split tube. It is rotatably mounted at both ends, on the base 67 of the inductance device 60 and on a plate 73 standing on the panel 67, by means of the bearings 75 and 74 respectively.

A motor 76 is mounted on the plate 73 and drives the two driving pinions, namely a large diameter pinion 81 and a small diameter pinion 82, which work together respectively with the two driven pinions, namely a small diameter pinion 83 mounted near an end of the worm screw 72 next to the motor 76 and a large diameter pinion 84 mounted at an end of the split tube 65 next to the motor 76. Thus, the worm screw 72 rotates faster than the motor and the split tube 65 rotates slower than the motor.

A slide assembly 90 includes a Y-shaped slide 91 having a stem 92 and two branches 93 and 94. The stem 92 has a thickness slightly smaller than the width of the slit 66 of the split tube and it fits into this slit. A free end of the stem 92 supports a threaded cylinder 95 which is crossed by the worm screw 72 and works in conjunction with the latter. The two branches 93 and 94 are identical and will be described with reference to the branch 94 which supports a transversal piston cylinder 96 in which is located a tubular piston 97 open at one end. On a base 100 of the piston cylinder 96, and inside the piston 97, extends a core 101. A screw 102 penetrates freely the base 100 of the piston cylinder 96, the core 101 and turns in the internal thread in a base 103 of the piston 97. A helical spring 104 is inserted between the core 101 and the base 103 of the piston 97.

An external face of the base 103 of the piston 97 has a cap 105 supporting a shaft 106. A V-shaped slide support 107 is rotatably mounted about the shaft 106 located in the middle of this support. The slide support 107 has respectively at its ends two sliders 111 and 112 in contact with an internal face of the cylinder 61 of the inductance device 60 and on the tube 63 of the latter, respectively. The spring 104 assures elastic pressure of the sliders 11 and 112 on the inductance device 60. The screw 102 restricts the movement of the piston 97 towards the outside of the piston cylinder 96.

The slide support 107 is hollow so that liquid coolant may pass through it, in a manner not shown in FIG. 4.

During operation, rotation of the motor 76 causes a rotation of the worm screw 72, that is to say a translational movement of the slide assembly 90 along the worm screw; it also causes a rotation of the split tube 65, that is to say a rotation identical to that of the slide assembly 90 around the worm screw. The pinions 81 to 84 are selected so as to produce gearing ratios so that the slide 90 traces a spiral path corresponding to the spiral form of the tube 63 of the inductance device 60.

What is claimed is:

1. An inductance device formed by an asymmetrical line and including:

a surface conductor, a wire conductor located along and close to the surface conductor and having a first end which is short-circuited with the surface conductor and a second end, and positioning devices for maintaining the wire conductor in a determined position in relation to the surface conductor wherein said positioning devices include a plurality of insulating devices connecting said wire conductor to said surface conductor the surface conductor comprises a cylindrical tube having an axis, an internal surface and an external face, and wherein the wire conductor is located near to of the faces of the surface conductor.

2. An inductance device according to claim 1, wherein the wire conductor is of spiral form so as to form turns which are separated from each other and so as to form, with these turns, a coil which is coaxial with the cylinder.

3. An inductance device according to claim 2, wherein the coil is located inside the cylinder.

4. An inductance device according to claim 2, wherein any two adjacent turns of the coil are separated axially by a distance at least four times that of a radial distance between the wire conductor and the cylinder.

5. An inductance device according to claim 2, which includes a first connector formed by the first end of the wire conductor and a second connector adjacent to the first and rigidly attached to the surface conductor.

6. An inductance device according to any one of the preceding claims, which includes a short-circuit device to produce a short-circuit between the surface conductor and the wire conductor, at any point along the wire conductor.

7. An inductance device according to claim 3, which includes a short-circuit device to produce a short-circuit between the cylinder and the coil, at any point along the coil, this short-circuit device including:

a split tube having a longitudinal slit, coaxial with the cylinder, and rotatably mounted about the axis of the cylinder, a worm screw coaxial with the cylinder and rotatably mounted in the split tube about the axis of the cylinder, a slide operating together with the worm screw through the slit of the split tube and moving along the worm screw when the latter is in rotation, and around the axis of the cylinder when the split tube is in rotation.

and contact devices supported by the slide to form an electrical sliding contact between any point of the coil and an adjacent point of the cylinder.

8. An inductance device according to claim 1, wherein said plurality of insulating devices connect the wire conductor to the surface conductor in a plurality of areas distributed along the wire conductor.

* * * * *